United States Patent [19]

Jimenez et al.

[11] 4,446,644

[45] May 8, 1984

[54] TELESCOPE SIGHT MOUNT SYSTEM FOR FIREARMS

[76] Inventors: Ivan Jimenez; Irving N. Rubin, both of 5555 Treadwell, Wayne, Mich. 48184

[21] Appl. No.: 326,636

[22] Filed: Dec. 2, 1981

[51] Int. Cl.[3] ..... F41G 1/38

[52] U.S. Cl. ..... 42/1 ST; 33/250

[58] Field of Search ..... 42/1 ST; 33/250, 245

[56] References Cited

U.S. PATENT DOCUMENTS 3,579,840 5/1971 Heinzel ..... 42/1 ST 3,835,565 9/1974 Weast ..... 42/1 ST

FOREIGN PATENT DOCUMENTS 1289286 2/1962 France ..... 42/1 ST

OTHER PUBLICATIONS

"Weaver See-Thru Mounts," *The American Rifleman,* p. 45, Jun. 1977.

*Primary Examiner*—Charles T. Jordan

*Attorney, Agent, or Firm*—Stephenson & Boller

[57] ABSTRACT

In a firearm telescope sight mount system a base is mounted on a firearm and a mount member is operatively engaged with the base. The mount member includes a receptacle for reception of the body of a telescope sight. The base and the mount member are operatively engaged via a dovetail type connection, comprising a channel in the mount and a slide on the base. The mount is resiliently flexible from its free position in response to externally applied forces so that its channel expands slightly allowing the mount to be slid axially onto the slide of the base. Upon release of the external forces, the resiliency results in a forceful clamping action on the base.

4 Claims, 6 Drawing Figures

TELESCOPE SIGHT MOUNT SYSTEM FOR FIREARMS

BACKGROUND AND SUMMARY OF THE INVENTION

The present invention relates to telescope sight mount systems for firearms, and is specifically concerned with a new and improved telescope sight mount construction.

A known conventional arrangement for mounting a telescope sight on a firearm such as a rifle involves the attachment of a base to the firearm and the subsequent attachment of a mount to the base. The mount contains a receptacle, or cradle, for a telescope sight. In a typical telescope mounting there may be two mounting locations which are spaced apart along the length of the firearm thereby providing a two point mounting for a telescope sight. Each base includes a slide portion, or a key, which extends axially lengthwise of the firearm barrel. The slide portion may be any one of a number of possible shapes. One shape is analogous to the tenon of a dovetail. The mount also includes an attaching mechanism via which the mount is removably secured to the base. The attaching mechanism is a multi-piece construction which clamps onto the slide portion of the base. The multi-piece construction may be generally described as comprising two separate pieces loosely held together by a thumbscrew fastener. In this loosely held condition the thumbscrew may be adjusted allowing the two separate pieces to be slipped onto the slide portion of the base. When the thumbscrew is now tightened, the two pieces are drawn together to thereby clamp onto the slide portion of the base.

Because of the inherent nature of this prior attachment mechanism, loosening of the thumbscrew can occasion a similar loosening of the mount on the base. This can give rise to loss of sighting adjustment of the telescope sight on the firearm. Carried to an extreme the further loosening of the thumbscrew could result in the mount separating from the base and the distinct possibility of damage to the telescope sight. Examples of this type of attaching mechanism are shown in U.S. Pat. Nos. 3,040,433; 3,259,986; 2,632,251; and 2,803,907.

The present invention is directed to a new and improved telescope sight mount system in which a one-piece mount contains the entirety of a channel via which the mount clamps on a base. The one-piece mount comprises a receptacle portion defining a receptacle for the body of the telescope sight and a base-engaging portion containing the channel. The channel is of a dovetail shape. The receptacle portion, when viewed axially, is of generally semicircular shape having free distal ends. The receptacle and base-engaging portions have a common juncture at a central region of the receptacle portion. When the mount is in its free condition, the transverse shape of the channel is such in relation to the transverse shape of the slide portion of the base that the channel cannot be slid onto the base. However, when oppositely directed forces are applied to the distal ends of the receptacle portion, the inherent elasticity of the material and construction of the mount causes the base-engaging portion to slightly enlarge the transverse shape of the channel whereby it may now be slid axially onto the slide portion of the base. These oppositely directed forces may be conveniently applied by simply pinching the free distal ends of the base between the thumb and forefinger. Upon release, the elastic resiliency of the mount causes the base-engaging portion to return toward its free shape whereby it clamps onto the slide portion of the base thereby retaining the mount in position on the base. In order to provide additional assurance for clamping the mount on the base, a locking screw is provided which extends transversely across the channel between transverse opposite sides of the base-engaging portion. The locking screw is tightened to urge the opposite sides of the base-engaging portion toward each other, and hence urge the transverse shape of the channel toward contraction, thereby more forcefully clamping the transverse sides of the base-engaging portion against the transverse sides of the slide portion of the base.

A clamp is also applied over the receptacle of the mount, and the two are separably fastened by screws so as to thereby removably clamp the telescope in the receptacle.

In one embodiment of mount the common juncture between the base-engaging portion and the receptacle portion occurs with the base-engaging portion being approximately tangent to the central region of the receptacle portion. In that embodiment the nature of the common juncture allows the base-engaging portion to resiliently flex in response to application of the oppositely directed forces to the free distal ends of the receptacle portion.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time for carrying out the invention.

DESCRIPTION OF THE PREFERRED EMBODIMENT

Figure 1:
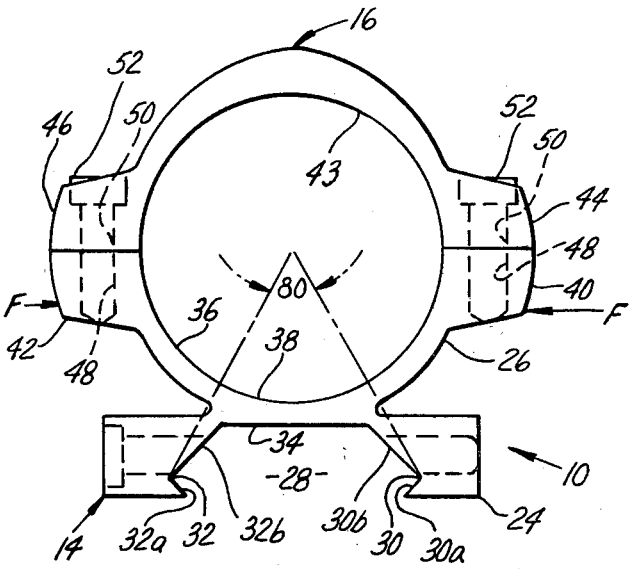
FIG. 1 illustrates an axial view of a portion of a telescope sight mount embodying principles of the present invention.
Figure 3:
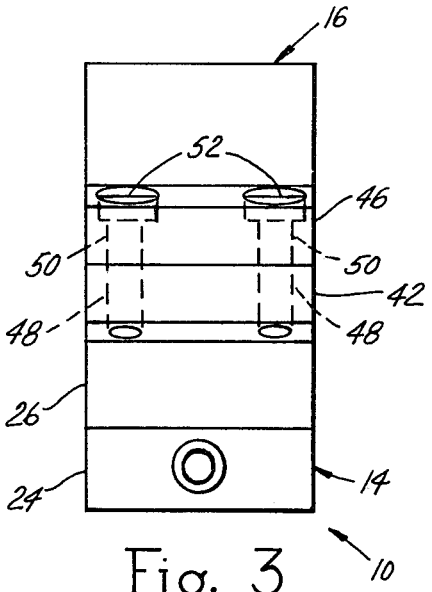
FIG. 3 is a side elevational view of FIG. 1.
Figure 2:
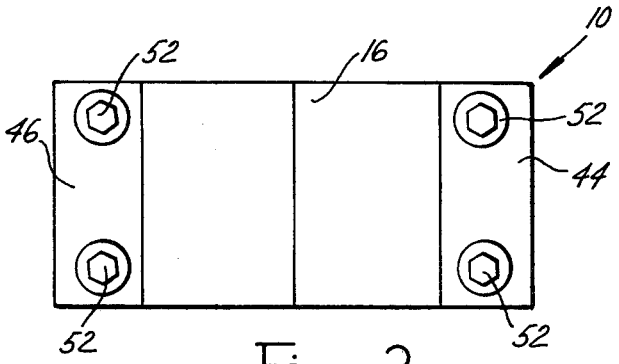
FIG. 2 is a top plan view of FIG. 1.
Figure 4:
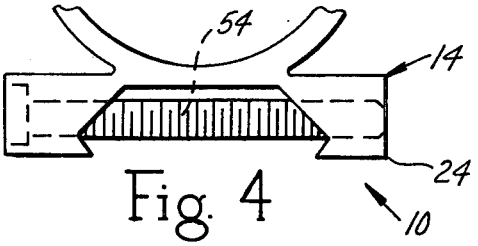
FIG. 4 is a fragmentary axial view illustrating a further portion of the sight mount.

FIGS. 1 and 4, when considered together, illustrate a telescope sight mount 10 of the present invention at one mounting location on a firearm (not shown). The sight mount 10 comprises a mount member 14 and a clamp member 16, the latter two being fully shown in FIG. 1. The mount is used with a base 12 shown by itself in FIG. 6. The base 12 is adapted to be attached directly to the firearm and may be of a suitable construction for conformance with the particular mounting location on the firearm. By way of example the base 12 in FIG. 6 has a concave contoured lower surface 18 which conforms to a convex curvature of the firearm. This allows the surface 8 to be disposed directly against the firearm with the base being attached thereto by means of one or more fastening screws 20 which pass through suitably counterbored holes in the base and into suitable tapped holes in the firearm. The base 12 further includes an axially extending slide portion referred to by the general reference numeral 22. The slide portion 22 provides the means via which the mount 14 is operatively engaged with base 12. The illustrated base represents one example of a number of existing bases already on the market, and the illustrated preferred embodiment of the present invention is disclosed for use with the base shown in FIG. 6.

Mount 14 comprises a base-engaging portion 24 and a receptacle portion 26. The base-engaging portion 24 has a generally rectangular overall shape when viewed axially as in FIG. 1; an axially extending channel 28 is provided in the underside of base-engaging portion 24. The channel may be considered as having a general dovetail shape as viewed in FIGS. 1 and 4 comprising non-planar side walls 30 and 32 respectively. In the illustrated embodiment these non-planar side walls comprise two intersecting planar sides 30*a*, 30*b* in the case of side wall 30 and 32*a*, 32*b* in the case of side wall 32. The two walls 30, 32 are joined by a planar wall 34.

Figure 6:
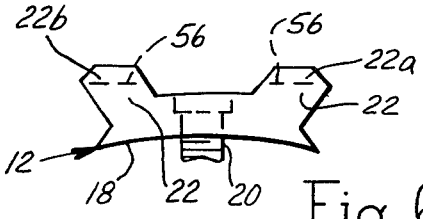
FIG. 6 is an axial end view of one type of base with which the mount is used.

As can be seen in FIG. 6 the slide portion 22 of base 12 has transversely spaced portions 22*a*, 22*b* which are complementary to the respective side walls 30 and 32 of channel 28. The slide portion 22 may therefore be considered as comprising a general dovetail shape complementary to the dovetail channel 28 even though the slide portion 22 will not fill the entirety of the channel when the two are operatively engaged.

The receptacle portion 26 of mount 14 comprises a construction which defines a semicircular receptacle 36 which receives the body of a telescope sight (not shown). The receptacle portion includes, when viewed axially, a central region 38 with there being a common juncture between the central region 38 and the base-engaging portion 24. The wall of the receptacle projects away from the base-engaging portion 24 on opposite sides and terminates in free distal ends. Each distal end is fashioned with an enlarged portion 40 and 42 respectively.

Clamp 16 has a semicylindrical wall 43 conforming to the contour of the body of the telescope sight. The distal ends of the clamp are provided with enlarged portions 44, 46 respectively which fit onto the portions 40 and 42 respectively of mount 14. A pair of axially spaced tapped holes 48 are provided in each of the portions 40 and 42. Corresponding counterbored holes 50 are provided in the portions 44 and 46 in alignment with the underlying holes 48. Fastening screws 52 are passed through the counterbored holes to threadedly engage the underlying tapped holes and thereby removably secure the clamp 16 to the mount 14 so as to removably clamp the telescope body.

The present invention takes advantage of the inherent elasticity of the metal and construction of mount 14. While the channel 28 is defined completely by the one-piece mount 14, it nonetheless is slightly resiliently flexible so that it can be secured to the base. FIG. 1 illustrates mount 14 in its free condition. In this condition the dovetail channel 28 possesses given dimensional characteristics. These dimensional characteristics are selected in relation to the dimensional characteristics of slide 22 of base 12 such that with mount 14 in its free condition it is impossible to slide mount 14 onto base 12. Because of the inherent nature of a dovetail connection, the only way to operatively engage mating one-piece dovetail parts is to slide one onto the other. This is where the resilient flexibility of mount 14 comes into play.

Figure 5:
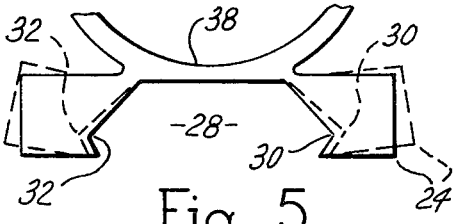
FIG. 5 is a fragmentary view similar to FIG. 4 illustrating operation.

In order to mount the member 14 on base 12, oppositely directed forces F are applied to the free distal ends of the receptacle portion of mount 14. These oppositely directed forces are applied to the enlarged portions 40 and 42 as shown in FIG. 1 after clamp 16 has been disassembled from member 14. By applying the forces in the manner indicated, the base-engaging portion 24 is flexed slightly to slightly enlarge, or expand, the transverse shape of the dovetail channel 28 in an amount sufficient to allow the base 12 and the base-engaging portion 24 to be slid axially together. FIG. 5 illustrates this on an exaggerated scale where the broken lines show the flexed condition. Once the two members 12 and 14 have been operatively associated, release of the oppositely directed forces F will enable the inherent resiliency of the member 14 to return the member toward its free state. In doing so the base-engaging portion 24 thereby clamps effectively on the slide 22. This clamping action by itself in many instances may be sufficient to securely hold the mount on the base. However in order to ensure that the mount does not move on the base it is preferable that a locking screw 54 be provided as shown in FIG. 4. The locking screw passes through a counterbored hole in one transverse side of the base-engaging portion, across the channel 28, and threads into a tapped hole in the opposite side of the base-engaging portion. The portions 22*a*, 22*b* include clearance grooves 56 for screw 54. The screw is assembled after the members 12, 14 have been operatively engaged and is tightened to draw the two transverse sides of the base-engaging portion toward each other thereby providing a supplementary clamping force which is in addition to the natural resilient clamping force of the member 14 by itself.

While a number of possible materials are suitable for the mounting system members, the preferred material is extruded aluminum. The external surface of the aluminum may be left with a metallic looking appearance, or it may be endowed with a non-metallic looking appearance if desired.

It will also be observed that in the embodiment 10 the thickness at the common juncture between the base-engaging portion and the receptacle portion also essentially corresponds to the thickness of the receptacle portions between the central portion and the enlarged portions 40 and 42. It will be observed that the central common juncture region subtends an acute angle about the center of the receptacle. As can be seen in FIG. 1 the acute angle which the central common juncture region subtends is included within the acute angle 80 which the dovetail channel subtends about the longitudinal axis of the receptacle.

The foregoing has described a new and improved telescope sight mount system for firearms. While a preferred embodiment has been disclosed, it will be appreciated that other embodiments are contemplated within the scope of the invention as set forth in the following claims.

We claim:

1. In a firearm telescope sight mount system the combination comprising a longitudinally extending base adapted to be mounted on a firearm, a one-piece non-see-through type mount engaging said base, and a semi-circular clamp on said mount, said mount comprising a semi-circular receptacle portion and a base-engaging portion, said base-engaging portion engaging said base, said semi-circular receptacle portion cooperating with said semi-circular clamp so as to be adapted for embracing the body of a telescope sight, said base being constructed and arranged to have a slide portion having a transverse shape in the form of a general dovetail shape, said base-engaging portion being constructed and arranged to have a channel of generally complementary dovetail shape whereby the mount and base can be assembled together only by axially sliding the mount onto the base, said base-engaging portion engaging said slide portion of said base at longitudinally extending, transversely spaced apart sides of said slide portion, said base-engaging portion being constructed and arranged so as to integrally merge into said semi-circular receptacle portion in transversely inwardly set relation to said sides within a subtended acute angle with respect to the longitudinal axis of the receptacle portion, said channel also subtending an acute angle with respect to the longitudinal axis of the receptacle, and said angle subtended by the merger of said base-engaging portion with said receptacle portion being wholly included within the angle subtended by said channel.

2. In a firearm telescope sight mount system as set forth in claim 1, said mount and said base comprising respective transverse shapes which in their respective free conditions preclude the base and the mount from being operatively engaged by axially sliding one onto the other but one of which is operable in response to application of external force through the inherent elasticity of its own arrangement and construction to slightly reconfigure its own transverse shape so that it can be slid axially onto the other and in response to release of the external force after having been slid onto the other, resiliently clamps onto the other.

3. The combination set forth in claim 2 wherein the channel is in the mount and including a locking screw extending transversely across the channel and operatively arranged on the mount for contracting the transverse shape of the channel so that the mount can be more securely locked on the slide portion of the base after the two have been slid axially together.

4. The combination as set forth in claim 2 wherein the base-engaging portion merges into the receptacle portion in a tangential fashion.

* * * * *